United States Patent [19]

Moore

[11] Patent Number: 4,765,414

[45] Date of Patent: Aug. 23, 1988

[54] COREBARREL

[75] Inventor: Terence A. Moore, Montrose, Scotland

[73] Assignee: Diamant Boart Stratabit Limited, Scotland

[21] Appl. No.: 50,357

[22] Filed: May 18, 1987

[30] Foreign Application Priority Data

May 17, 1986 [GB] United Kingdom ..... 8612052

[51] Int. Cl.[4] ..... E21B 25/16; E21B 49/02

[52] U.S. Cl. ..... 175/44; 175/236; 175/246

[58] Field of Search ..... 175/44, 244, 58, 236, 175/237, 239, 246, 257; 33/304; 73/153, 151

[56] References Cited

U.S. PATENT DOCUMENTS

| | | | |
|---|---|---|---|
| 1,701,724 | 2/1929 | McLaughlin | 175/44 |
| 1,769,152 | 7/1930 | McLaughlin | 175/44 X |
| 1,777,010 | 9/1930 | McLaughlin | 175/44 X |
| 2,489,566 | 11/1949 | Engle | 175/44 |
| 2,555,275 | 5/1951 | Millison | 73/153 X |
| 3,207,239 | 9/1965 | Thigel | 175/44 |
| 4,638,872 | 1/1987 | Park et al. | 175/244 X |

OTHER PUBLICATIONS

Rowley et al., "Oriented Cores", Apr. 24, 1964.

*Primary Examiner*—Stephen J. Novosad
*Assistant Examiner*—Hoang C. Dang
*Attorney, Agent, or Firm*—Reed Smith Shaw & McClay

[57] ABSTRACT

A corebarrel for use downhole and having an outer tube and an inner tube which are relatively rotatable and interconnected through a bearing assembly, and a solid state survey device for use in oriented coring and disposed within the inner tube below the bearing assembly.

6 Claims, 1 Drawing Sheet

COREBARREL

This invention relates to a corebarrel for use in oriented coring.

BACKGROUND OF THE INVENTION

Oriented coring is a technique used in drilling, and refers to the production of a core that is marked by a small groove. The position of this groove can be related to magnetic or true North. This allows core analysis to determine any bedding planes or fracture alignments to help geologists produce a three dimensional map of a structure. It also enables the analysis of directional porosity and permeability in fluvial deposits. This can help to define and examine the reservoir structure which can make any recovery of deposits more efficient due to use of suitable selected recovery systems.

It is known to perform oriented coring using a corebarrel modified at the bottom by a cutting mechanism which will cut three small grooves into the core. One of these grooves is identified as the main groove. The cutting mechanism is fixed in relation to the top part of the inner tube of the corebarrel by means of threaded connections in the inner tube. A magnetic multishot survey tool is run on top of the corebarrel surrounded by a non magnetic drill collar. This survey tool has its tool face aligned mechanically to the cutting mechanism which creates the main groove.

This system can give good but inconsistent results, mainly due to problems associated with the survey tool. These include:

1. No survey due to excessive downhole temperatures (fogged or melted film).
2. Failure of the survey tool due to mechanical damage during coring.
3. Failure of the survey tool due to "go-devilling" (battery pack).
4. Good survey pictures but meaningless results (rotation of toolface or groove).

In addition, it is necessary to stop all rotation and pumps in order to get a good photographic picture, and this is not good drilling practice.

A similar previously-known system used solid state survey equipment which does away with the need for a camera and film. The tool using this system is capable of operating continuously whilst coring. The results obtained are generally similar to those using the photographic system, but the associated problems are reduced mainly due to the elimination of the film recording system.

SUMMARY OF THE INVENTION

According to the present invention there is provided a corebarrel for use downhole having an outer tube and an inner tube which are relatively rotatable and interconnected through a bearing assembly, and a solid state survey device for use in oriented coring and disposed within the inner tube below the bearing assembly.

Mounting the survey device below the bearing assembly ensures that the inner tube wall surrounding it is not rotating relative to it; this reduces vibration in the survey device. Resilient mountings may be provided between the device and the inner tube further to reduce vibration.

The survey device is preferably held aligned with a scribing tool disposed at a lower end of the corebarrel for marking the core entering the corebarrel. The alignment may be achieved by cooperating male and female cam formations, for example, a spline connection, between the survey device and the inner tube. The survey device may be held against axial movement within the corebarrel, for example by means of a latch mechanism.

Preferably also passageway means are provided through the corebarrel for flow of drilling fluid; the passageway means may include flow paths between the inner and outer tubes and also between the survey device and the inner tube; the latter path may have a valve for selectively closing off flow.

The survey device may be similar to prior art solid state electronic recording devices, and more than one such device may be provided for checking the accuracy of the main device and for providing a back-up.

An embodiment of the present invention will now be described by way of example with reference to the accompanying drawing in which:

Figures 1, 2:
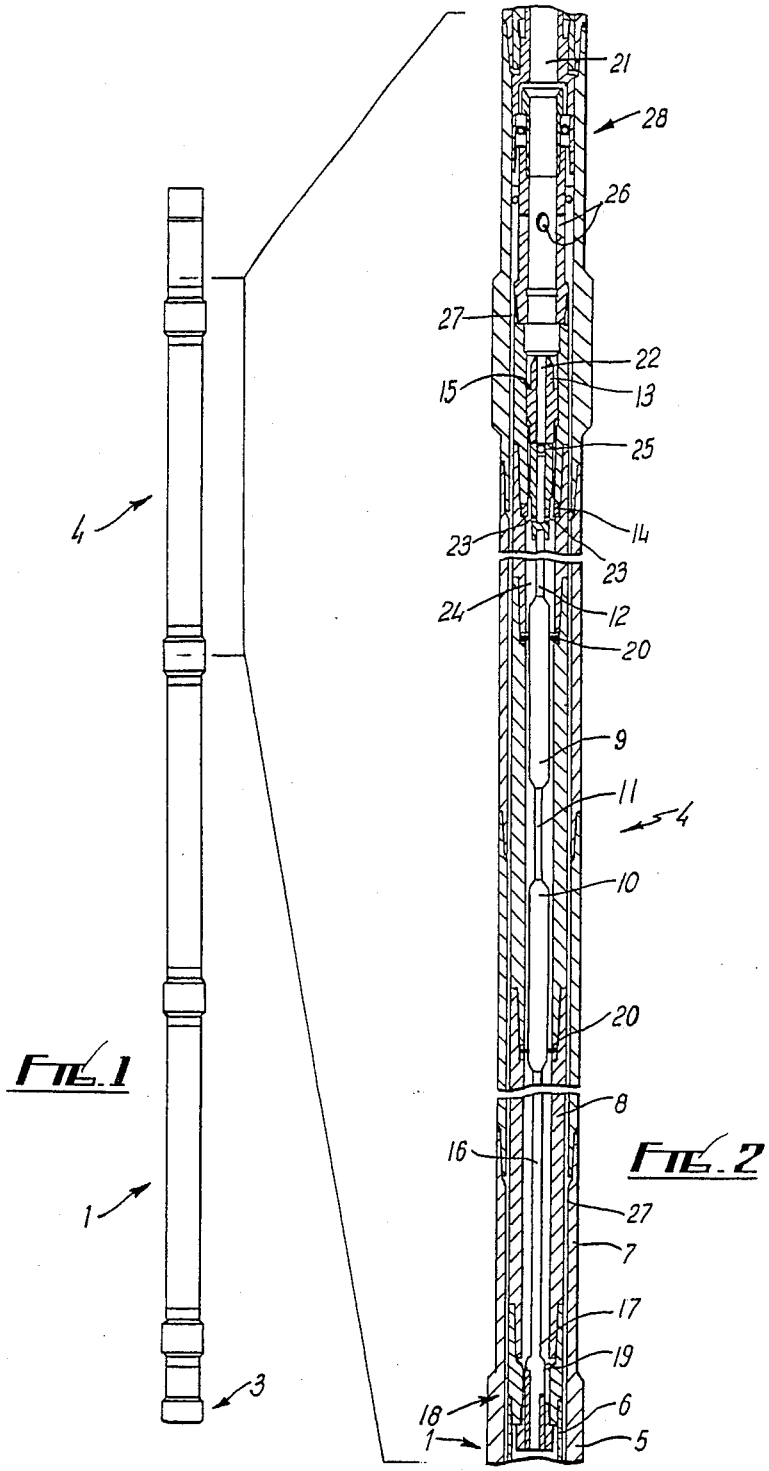
FIG. 1 is a side view of a corebarrel of the present invention.
FIG. 2 is a sectional view of a portion of the corebarrel of FIG. 1 as indicated on the drawing.

Referring to the drawing, the corebarrel of this embodiment of the invention has a conventional core-collecting section 1 which is modified by having a scribing device (not shown) on its inner tube 6 at a lower end 3. At its upper end the core-collecting section 1 is screwed into a housing 4 which extends the outer tube 5 and inner tube 6 of the corebarrel upwardly through outer and inner walling 7 and 8, respectively. The outer and inner walling 7, 8 are both of non-magnetic metal and house a survey instrument assembly of a pair of solid-state Sperry Sun E.S.I. electronic recording devices 9, 10 interconnected by a tube 11. The lower device 10 is inverted in order to allow both sensors 9, 10 to be housed in that part of the walling which is non-magnetic, without unduly extending the length of the non-magnetic portion.

From the upper end of the survey device 9 extends a tube 12 which carries a latch mechanism 13 above a landing ring 14. The latch mechanism 13 engages with a shoulder 15 on the inner walling 8 to prevent upward axial movement of the survey assembly relative to the inner walling 8.

The lower survey device 10 has a tube 16 extending downwardly from it and terminating in a male cam 17 which mates with a female cam 18 secured to the inner walling 8. The cams 17, 18 are held against relative rotation by a splined connection 19, and prevent both rotation and downward axial movement of the survey assembly relative to the inner walling 8.

Resilient annular centralisers 20 extend inwardly from the inner walling 8 and engage the outer wall of the survey devices 9, 10 to hold them in position and absorb any vibration or shock, thereby protecting the devices 9, 10.

A fluid passageway 21 extending from the surface through the drill string continues through a central bore 22 in the latch mechanism 13 which opens through lateral ports 23 into the annular space 24 between the survey assembly and the inner walling 8. A ball valve 25 is disposed in the bore 22 to close off flow of fluid to the ports 23.

The passageway 21 has side ports 26 above the latching mechanism 13 leading to the annular space 27 between the outer and inner walling 7, 8 and thence between the outer and inner tubes 5, 6 of the core-collecting section 1.

A ball bearing assembly 28 between the outer and inner walling 7, 8 allows rotation of the outer walling 7 and outer tube 5 while the inner walling 8 and inner tube 5 remain stationary. The bearing assembly 28 is disposed above the latch mechanism 13 and survey devices 9, 10.

In use the corebarrel is first flushed with drilling fluid supplied from the surface through the passageway 21. The ball valve 25 is opened to allow the fluid to flow through the bore 23 and, via the ports 23, through the annular space 24 between the survey devices 9, 10 and the inner walling 8, as well as through the ports 26 and the annular space 27 to the bottom of the core-collecting section 1. After flushing, the ball valve 25 is closed, preventing further flow of fluid into the space 24.

Oriented coring is then commenced in conventional manner and readings taken by the survey devices 9, 10 at intervals. The readings are instantaneous by virtue of the electronic solid state nature of the devices, and it is not therefore necessary to interrupt coring while taking the readings.

Modifications and improvements may be made without departing from the scope of the invention.

I claim:

1. A corebarrel for use downhole, comprising:

a. an outer tube defining a through bore;

b. an inner tube disposed within the outer tube and defining a through bore;

c. a bearing assembly between the inner tube and the outer tube providing rotation of the outer tube relative to the inner tube;

d. a survey device disposed within the inner tube below the bearing assembly, said survey device including a solid state survey means for use in oriented coring;

e. mutually co-operating splines on the survey device and the inner tube to prevent rotation of the survey device relative to the inner tube;

f. a latch mechanism on the survey device;

g. a downwardly-directed shoulder on the inner tube, said shoulder engaging the latch mechanism to prevent upward movement of the survey device relative to the inner tube;

h. the inner tube and the outer tube defining between them a first annular passageway, and the survey device and the inner tube defining between them a second annular passageway, the inner tube having an aperture therein above said shoulder whereby the through bore in the inner tube communicates with said first annular passageway at a location above said second annular passageway; and i. means disposed in said inner tube for selectively closing the through bore of the inner tube at a location above said second annular passageway but below said aperture.

2. A corebarrel as claimed in claim 1, wherein the survey device is spaced inwardly of the inner tube by resilient mountings.

3. A corebarrel as claimed in claim 1, wherein the latch mechanism defines a through bore coaxial with the inner tube and communicating with said second passageway, and the through bore of the latch mechanism including a valve seat for receiving a valve member to close off the through bore of the latch mechanism.

4. A corebarrel as claimed in claim 1, including a battery disposed within the inner tube and electrically connected with the survey device to provide electrical power for the survey device.

5. A corebarrel as claimed in claim 1, wherein the inner tube and the outer tube are of non-magnetic material in an area adjacent the survey device.

6. A corebarrel as claimed in claim 1, wherein a second solid state survey device is provided in electronic communication with the first survey device, the second survey device being inverted relative to the first survey device.

* * * * *